US006048128A

United States Patent [19]

Jones, III et al.

[11] Patent Number: 6,048,128

[45] Date of Patent: Apr. 11, 2000

[54] ROAD SPIKE DEVICE

[75] Inventors: Charles M. Jones, III, Friendsville; J. Alan Gilbert, Knoxville, both of Tenn.; Peter Furthner, Bad Vöslau, Austria

[73] Assignee: U.S. International Defence Technologies, Knoxville, Tenn.

[21] Appl. No.: 09/256,890

[22] Filed: Feb. 24, 1999

[51] Int. Cl.[7] ..... E01F 13/00

[52] U.S. Cl. ..... 404/6; 256/13.1

[58] Field of Search ..... 404/6, 9; 256/1, 256/13.1

[56] References Cited

U.S. PATENT DOCUMENTS

| | | | |
|---|---|---|---|
| Re. 35,373 | 11/1996 | Kilgrow et al. | 404/6 |
| 2,912,229 | 11/1959 | Persgard | 256/1 |
| 3,652,059 | 3/1972 | Groblebe . | |
| 4,101,235 | 7/1978 | Nelson . | |
| 4,382,714 | 5/1983 | Hutchison | 404/6 |
| 4,544,303 | 10/1985 | Glasmire | 404/6 |
| 4,624,600 | 11/1986 | Wagner et al. . | |
| 4,879,554 | 11/1989 | Diaz-Silveira . | |
| 4,995,756 | 2/1991 | Kilgrow et al. | 404/6 |
| 5,099,579 | 3/1992 | Chadwik | 30/366 |
| 5,123,774 | 6/1992 | Dubiel . | |
| 5,253,950 | 10/1993 | Kilgrow et al. . | |
| 5,288,164 | 2/1994 | Nasatka . | |
| 5,322,385 | 6/1994 | Reisman | 404/6 |
| 5,328,292 | 7/1994 | Williams . | |
| 5,330,285 | 7/1994 | Greves et al. . | |
| 5,452,962 | 9/1995 | Greves . | |
| 5,482,397 | 1/1996 | Soleau | 404/6 |
| 5,498,102 | 3/1996 | Bissel | 404/6 |
| 5,507,588 | 4/1996 | Marts et al. . | |
| 5,536,109 | 7/1996 | Lowndes | 404/6 |
| 5,611,408 | 3/1997 | Abukhader . | |
| 5,775,832 | 7/1998 | Kilgrow et al. | 404/6 |
| 5,820,293 | 10/1998 | Groen et al. . | |
| 5,839,849 | 11/1998 | Pacholok et al. . | |
| 5,890,832 | 4/1999 | Soleau | 404/6 |
| 5,904,443 | 5/1999 | Soleau | 404/6 |

*Primary Examiner*—James A. Lisehora
*Assistant Examiner*—Kristine N Markovich
*Attorney, Agent, or Firm*—Pitts & Brittian, P.C.

[57] ABSTRACT

A road spike device useful for deflating the tires of a fleeing or trespassing vehicle for the purpose of halting the vehicle. The road spike device preferably comprises a plurality of support arms and connected base members that are pivotally and replaceably secured to one another in a lazy tong configuration. A plurality of frangible cups are carried in spaced relation on the support arms. A hard rigid spike, adapted to allow air to flow through the spike, is carried by each of the frangible cups in a tight frictional fit such that spike is not readily removeable from frangible cup. As a vehicle tire (not shown) rolls onto the spike, the tire is impaled by the spike. As the tire progresses over the support arm with the spike embedded in the tire, the spike begins to rotate, relative to the axis of the frangible cup, creating a force moment against the outer lip of the frangible cup. This force moment causes the frangible cup to crumble, thus freeing the spike which remains embedded in the vehicle tire and deflates the vehicle tire. The spike of the preferred embodiment has a solid tapered tip and includes an elongated body, a shank, and a shoulder. The shank of the spike is provided with a concentric axial bore. An axial groove is provided in the elongated body of the spike and is in fluid communication with the axial bore of the shank. The preferred spike is provided with a plurality of circumferential bevels proximate the tip to act as barbs.

16 Claims, 3 Drawing Sheets

ROAD SPIKE DEVICE

TECHNICAL FIELD

This invention relates to the field of law enforcement or tactical security devices. More particularly, it relates to a rapidly deployable device for puncturing at least one of the pneumatic tires of a vehicle for the purpose of halting the vehicle.

BACKGROUND ART

Law enforcement personnel, as well as other tactical security personnel, are often called to either halt a fleeing vehicle, or to disable a vehicle that has trespassed into a secure area. It is desirable in these circumstances to slow the vehicle by partially, or completely, disabling the vehicle. One popular method of disabling a vehicle is by deflating its tires. Those skilled in the art appreciate that firing weapons at a fleeing vehicles tires is inefficient, often ineffective and presents an unacceptable risk of injury to law enforcement/security personnel or bystanders. Accordingly, a number of devices have been developed to serve as partial or complete barricades or that can be deployed across a roadway for the purpose of puncturing a vehicles pneumatic tires as the vehicle passes over the device. In this regard, U.S. Pat. No. 5,775,832, issued to Kilgrow, et al., on Jul. 7, 1998, discloses a compact tire deflator having pivotally connected opposing panels and one or more hollow spikes. U.S. Pat. No. 5,820,293, issued to Groen et al., on Oct. 13, 1998, discloses a vehicle tire deflation device comprising a base and a plurality of hollow tire deflating quills secured to the base. The base is configured so as to provide a tire penetrating orientation and a non-tire penetrating orientation. U.S. Pat. No. 5,839,849, issued to Pacholok et al., on Nov. 24, 1998, discloses a mechanical tire deflating device that deploys a folded deflating spike under a vehicle desired to be stopped. The spikes are extended when the mechanical device is under the vehicle to be stopped. U.S. Pat. No. 5,611,408, issued to Abukhader, on Mar. 18, 1997, discloses a vehicle disabling device that is propelled by a chase vehicle and deploys beneath a vehicle to be stopped. When deployed, the device extends a plurality of spikes that destroy and deflate the fleeing vehicle's tires. U.S. Pat. No. 5,536,109, issued to Lowndes, on Jul. 16, 1996, discloses a road vehicle halting device comprising a support member, a plurality of support elements and means for mounting the support elements on the support member in which each of the supporting elements supports a generally upwardly extending spike. The Lowndes device is configured in a "lazy tong" configuration and teaches that the spikes are pulled from the spike cups as the vehicle rolls over the device.

Also, U.S. Pat. No. 4,995,756, issued to Kilgrow et al., on Feb. 26, 1991, discloses a vehicle tire deflator having a pivoting tong configuration which utilizes a series of rocker arms and actuators to cant the spikes toward the tire upon impact. Kilgrow et al. teach that the spike is pulled from the socket as the tire rolls over the device. U.S. Pat. No. 5,253,950, issued to Kilgrow et al., on Oct. 19, 1993, (and reissue U.S. Pat. No. Re. 35,373 issued on Nov. 5, 1996) discloses an improvement over the device disclosed in Kilgrow et al. '756. U.S. Pat. No. 4,382,714, issued to Hutchison, on May 10, 1983, discloses a vehicle disabling means in the form of a plurality of spike like devices adapted to project perpendicular to a road surface to puncture one or more of a vehicle's tires. U.S. Pat. No. 3,652,059, issued to Groblebe, on Mar. 28, 1972, discloses a tire puncturing device to impede movement of a vehicle which utilizes a plurality of hollow, sharpened nail-like members releasably secured in spaced relation along the length and width of an elongated strip spread across the width of a roadway. U.S. Pat. No. 5,482,397, issued to Soleau, on Jan. 9, 1996, discloses a tire deflator which utilizes a spike and its associate support block being supported by a support mechanism adapted such that the spike and support block separate from the support mechanism as the tire rolls over the support mechanism.

Other devices known to the inventors include: U.S. Pat. No. 5,123,774, issued to Dubiel, on Jun. 23, 1992; U.S. Pat. No. 5,328,292, issued to Williams, on Jul. 12, 1994; U.S. Pat. No. 5,322,385, issued to Reisman, on Jun. 21, 1994; U.S. Pat. No. 5,099,579, issued to Chadwick, on Mar. 31, 1992; U.S. Pat. No. 5,452,962, issued to Greves, on Sep. 26, 1995; U.S. Pat. No. 5,330,285, issued to Greves et al., on Jul. 19, 1994; U.S. Pat. No. 5,507,588, issued to Marts et al., on Apr. 16, 1996; U.S. Pat. No. 5,288,164, issued to Nasatka, on Feb. 22, 1994; U.S. Pat. No. 4,879,554, issued to Dias-Silveira, on Nov. 7, 1989; U.S. Pat. No. 4,624,600, issued to Wagner, on Nov. 25, 1986; U.S. Pat. No. 4,101,235, issued to Nelson, on Jul. 18, 1978; and U.S. Pat. No. 4,544,303, issued to Glasmire, on Oct. 1, 1985.

While a number of the known devices teach that the spike is removed from a cup or socket as the tire rolls over the device, leaving the cup or socket undamaged to be refilled, our experience has shown that frequently the support arms themselves are damaged and that adapting the cup from a frangible material so that the pressure of the tire rolling over the spike and cup crushes the cup results in a greater number of spikes remaining in the tire. It has also been determined that different size vehicles react to spikes of a given height in different manners. For instance, spikes that are short enough to penetrate a passenger car-sized tire are often too short to penetrate truck or bus tires. However, a passenger car-sized tire will push over a spike that is long enough to completely penetrate a bus or truck tire tread.

Accordingly, it is an object of the present invention to provide a road spike device for deflating a vehicle tire that utilizes spikes received by a spike cup that is made of a frangible material such that the spike cup disintegrates as the tire rolls onto and over the spike.

Another object of the present invention is to provide a road spike device that is preferably in a self-extending tong configuration and in which the individual arms are readily removeable and replaceable.

Still yet another object of the present invention is to provide a road spike device which utilizes spikes of alternating heights so as to be effective for deflating tires of varying sizes for various types of vehicles.

Other objects and advantages over the prior art will become apparent to those skilled in the art upon reading the detailed description together with the drawings as described as follows.

DISCLOSURE OF THE INVENTION

In accordance with the various features of this invention, a road spike device for deflating fleeing, or trespassing, vehicle tires is provided. The road spike device preferably comprises a plurality of pivoting support arms that are pivotally and replaceably secured to one another in a lazy tong configuration. Frangible cups, in spaced relation are carried by selected support arms. A plurality of spikes, each adapted to allow air to flow through the spike, are carried by said frangible cups. In this regard, each cup is provided with a resilient insert with a center bore having an internal diameter that is sized so as to frictionally engage the outer diameter of the shank of the spike. As a vehicle tire rolls onto the spike, the tire is impaled by the spike. As the tire rolls over the spike, the spike begins to rotate relative to the axis of the cup, creating a force moment against the outer lip of the cup. This force moment causes the frangible cup to crumble, thus freeing the spike which remains embedded in the vehicle tire.

As stated above, the spikes are adapted to allow air to flow through the spike, thus deflating a vehicle tire when the spike is embedded in the vehicle tire. While the spike can simply be provided with an axial bore that extends from the shank to the tip of the spike, the preferred spike has a solid, tapered tip to strengthen the spike and allow the spike to more readily penetrate a tire tread. The shank of the spike is provided with a bore. An axial groove is provided in a side wall of the spike and is in fluid communication with the bore of the shank. Also, the preferred spike is provided with a plurality of circumferential bevels proximate the tip to act as barbs and substantially restrict movement of the spike in an outward direction away from the tire. In the preferred embodiment, spikes of alternating height are utilized so as to allow the road spike device to be effective against a wide variety of vehicles. In the preferred embodiment, the road spike device is provided with a hinged case in which to transport the device and straps that allow the securement and/or retrieval of the device.

BEST MODE FOR CARRYING OUT THE INVENTION

Figure 1:
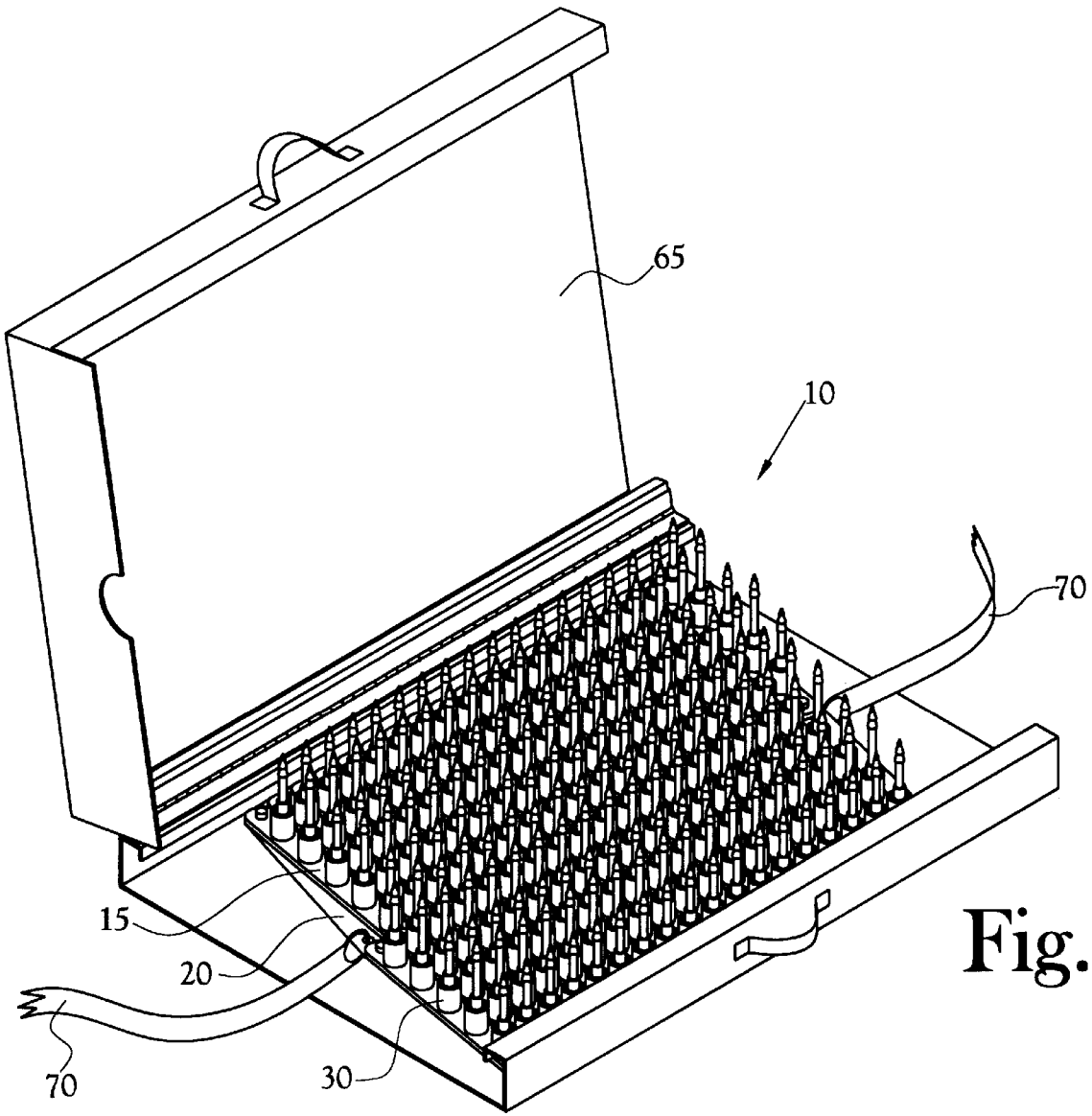
FIG. 1 illustrates a perspective view of the road spike device of the present invention as stored in the preferred carrying case.

A road spike device, constructed in accordance with the present invention, is illustrated generally as 10 in the figures. Road spike device 10 is useful for deflating the tires of a fleeing or trespassing vehicle for the purpose of halting the vehicle. The road spike device preferably comprises a plurality of support arms 15 and connected base members 20 that arc pivotally and replaceably secured to one another in a lazy tong configuration. In this regard, support arms 15 are parallel to adjacent support arms 15, and base members 20 are parallel to adjacent base members 20. Those skilled in the art recognize that in a lazy tongs configuration, the ends and center points of adjoining support arms 15 and base members 20 are pivotally connected. In the preferred embodiment, this pivotal connection is achieved by means of a nut and bolt assembly 25 such that individual support arms 15 or base members 20 can be readily and selectively replaceable.

A plurality of frangible cups 30 are carried in spaced relation on the support arms 15. While there are a number of means for affixing the frangible cups 30 to the support arms 15, in the preferred embodiment, a washer 32 is positioned within the frangible cup 30 in order to stabilize frangible cup 30 and a rivet 34fixedly secures frangible cup 30 to support arm 15. A hard rigid spike 35, adapted to allow air to flow through the spike 35, is carried by each of the frangible cups 30 in a tight frictional fit such that spike 35 is not readily removeable from frangible cup 30. In this regard, in the preferred embodiment, each frangible cup 30 is provided with a resilient insert 40 with a center bore 42 having an internal diameter that is sized so as to frictionally engage the outer diameter of the shank 44 of the spike 35. In the preferred embodiment, the resilient insert 40 is constructed of reinforced neoprene tubing. As a vehicle tire (not shown) rolls onto the spike 35, the tire is impaled by the spike 35. As the tire progresses over the support arm 15 with the spike 35 embedded in the tire, the spike 35 begins to rotate, relative to the axis of the frangible cup 30, creating a force moment against the outer lip of the frangible cup 30. This force moment causes the frangible cup 30 to crumble, thus freeing the spike 35 which remains embedded in the vehicle tire and deflates the vehicle tire.

As stated above, the spikes 35 are adapted to allow air to flow through the spike 35, thus deflating a vehicle tire when the spike 35 is embedded in the vehicle tire. While a tire-deflating spike can simply be provided with an axial bore that extends from the shank to the tip of the spike, it has been learned that there is a trade-off between the volume of air that can travel through the bore and the surface area of the tip of the spike. In this regard, it is desirable to have a spike with a small surface-area tip in order to increase the striking force of the spike against the tire. Accordingly, the spike 35 of the preferred embodiment has a solid tapered tip 46 to strengthen the spike 35 and allow the spike 35 to more readily penetrate a tire tread; further, spike 35 includes an elongated body 48 having a selected diameter, and a shank 44 having a diameter slightly larger than the diameter of the elongated body 48 thus defining a shoulder 52 that limits the depth of penetration of the spike into the tire. The shank 44 of the spike is provided with a, preferably concentric, axial bore 50. An axial groove 55 is provided in the elongated body 48 of the spike 35 and is in fluid communication with the axial bore 50 of the shank 44. Also, in the preferred embodiment, the spike 35 is provided with a plurality of circumferential bevels 60 proximate the tip 46 to act as barbs and substantially restrict movement of the spike 35 in an outward direction away from the tire.

Figure 2:
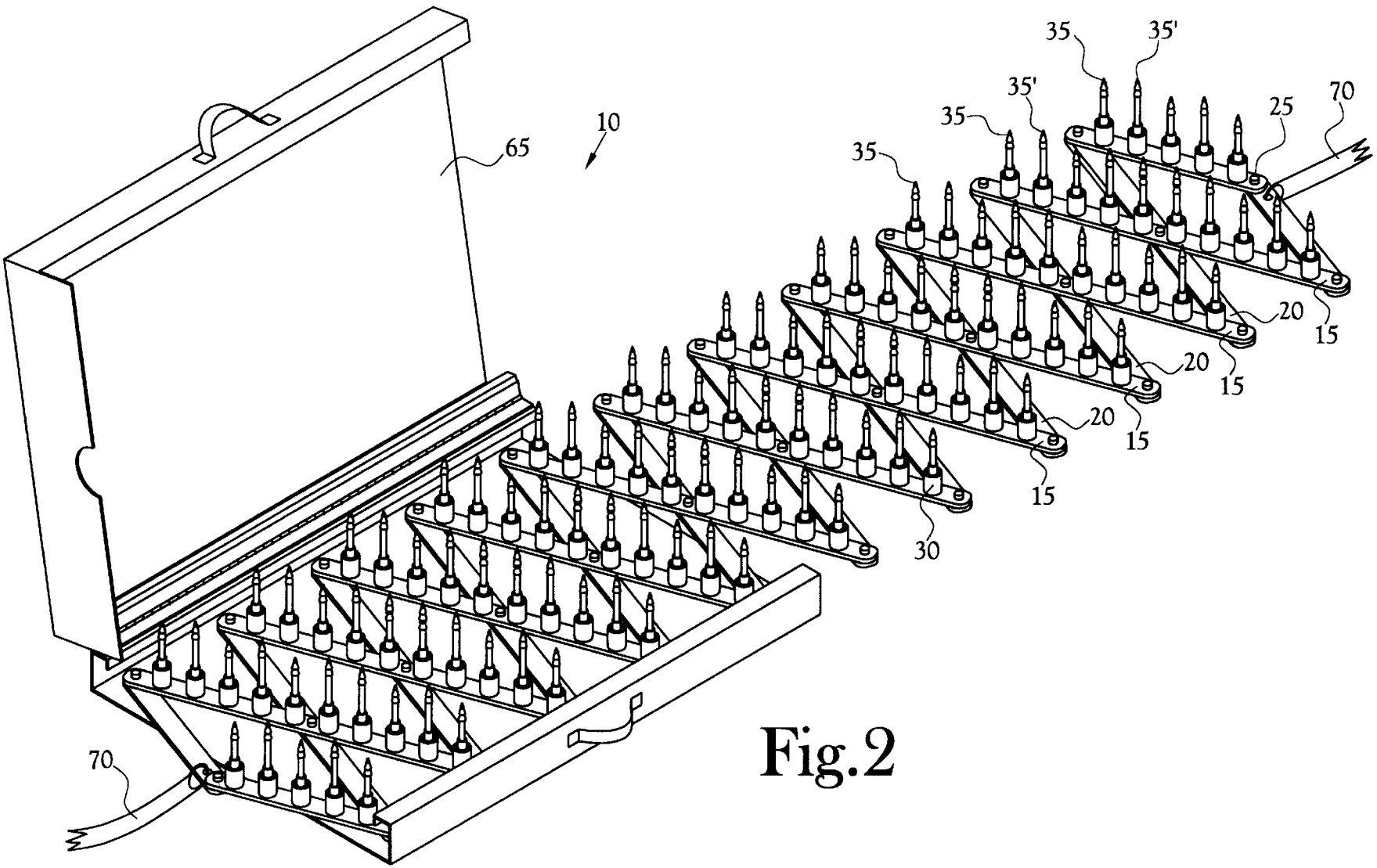
FIG. 2 illustrates a perspective view of the road spike device shown in FIG. 1 in a partially extended state.
Figure 3:
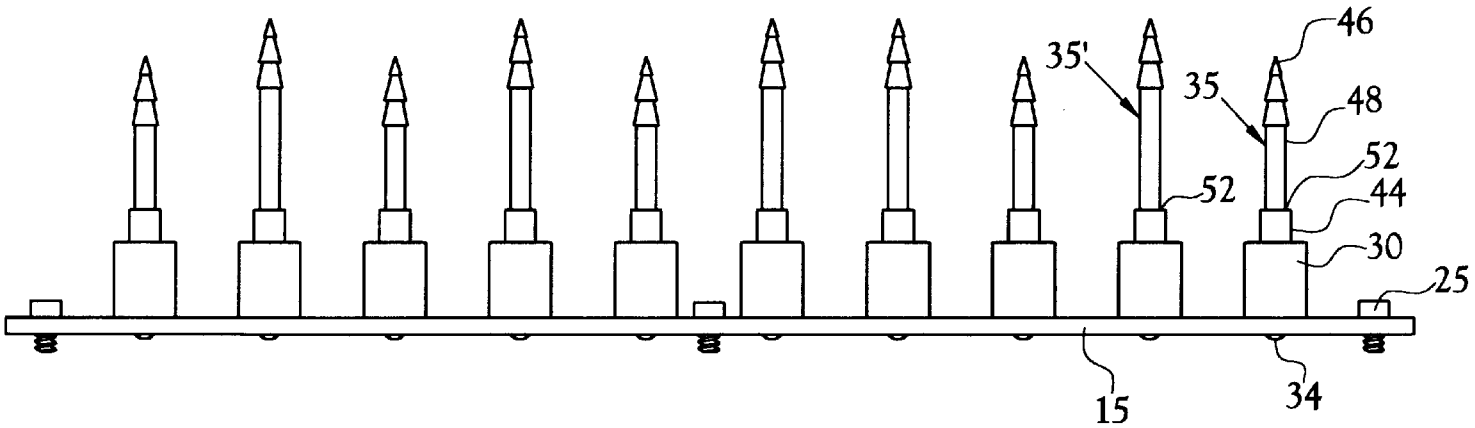
FIG. 3 illustrates a side elevation view of one support member on which are mounted spikes of alternating heights in accordance with the preferred embodiment.
Figure 4:
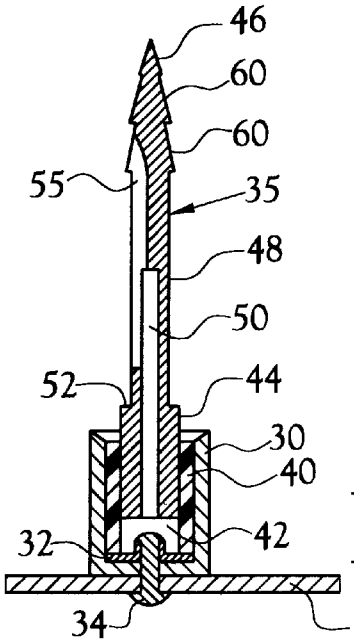
FIG. 4 illustrates a side elevation view in cross-section of the frangible cup and preferred spike of the present invention.

Those skilled in the art will recognize spikes long enough to adequately penetrate the casing of large bus and/or truck tires are prone to being pushed over by smaller vehicles such as passenger cars, and conversely, spikes, such as spike 35 that will impale a passenger car tire, are often of insufficient length to fully penetrate the casing of a large tire. Accordingly, the preferred embodiment of the road spike device 10 includes a plurality of spikes 35' that have a length selected to penetrate the casing of large tires typically found on commercial buses or large trucks. As best seen in FIG. 3, and also illustrated in FIG. 2, in the preferred embodiment of road spike device 10 spikes 35 and 35' are alternated on support arms 15 so as to allow the road spike device 10 to be effective against a wide variety of vehicles. In the preferred embodiment, the road spike device 10 is provided with a hinged case 65 in which to transport the road spike device 10 and straps 70 that allow the securement and/or retrieval of the device. In this regard, straps 70 can be utilized to secure the road spike device 10 to a tree, fence post or stake as needed. Straps 70 also provide a ready means for extending the road spike device 10 across a road way and for retrieving the road spike device 10 from the roadway.

From the foregoing description, it will be recognized by those skilled in the art that a road spike device for deflating a vehicle. . . offering advantages over the prior art has been provided. Specifically, the road spike device provides a road spike device in a self-extending tong configuration that utilizes spikes received by a cup that is made of a frangible material such that the spike cup disintegrates as the tire rolls onto and over the spike. Further, the road spike device of the present invention provides individual arms are readily removeable and replaceable. Those skilled in the art will further recognize that the present invention provides a road spike device which utilizes spikes of alternating heights so as to be effective for deflating tires of varying sizes for various types of vehicles.

While a preferred embodiment has been shown and described, it will be understood that it is not intended to limit the disclosure, but rather it is intended to cover all modifications and alternate embodiments and methods falling within the spirit and the scope of the invention as defined in the appended claims.

Having thus described the aforementioned invention,

We claim:

1. A road spike device for deflating a pneumatic tire, said road spike device comprising;

a plurality of support arms and base members cooperating in a lazy tong configuration, wherein said support arms are removably secured to adjoining said base members;

a plurality of frangible cups in spaced relation secured to said support arms;

a hardened spike seated in each of said plurality of frangible cups, said hardened spike including a shank, an elongated body, and a tapered tip;

an axial bore provided in said shank of said hardened spike; and an axial groove terminating proximate said tip disposed in said elongated body of said spike wherein said axial groove is in fluid communication with said axial bore.

2. The road spike device of claim 1 wherein said hardened spike further includes at least one circumferential bevel proximate said tapered tip.

3. The road spike device of claim 1 wherein a first plurality of said hardened spikes are of a first height and a second plurality of said hardened spikes are of a second height wherein said first height is greater than said second height and further wherein said hardened spikes of said first height and said hardened spikes of said second height are disposed in alternating fashion on said support arms.

4. The road spike device of claim 1 wherein said elongated body has a first diameter and said shank has a second diameter, wherein said second diameter is greater than said first diameter whereby said shank defines a shoulder.

5. The road spike device of claim 1 wherein said road spike device further comprises a hinged case for transporting and storing said road spike device.

6. The road spike device of claim 1 wherein said road spike device further comprises at least one strap member secured to an end of said road spike device.

7. A road spike device for deflating a pneumatic tire, said road spike device comprising;

a plurality of support arms and base members cooperating in a lazy tong configuration, wherein said support arms are removably secured to adjoining said base members;

a plurality of frangible cups in spaced relation secured to said support arms;

a hardened spike seated in each of said plurality of frangible cups, said hardened spike including a shank, an elongated body, a tapered tip, and at least one circumferential bevel proximate said tapered tip;

an axial bore provided in said shank of said hardened spike; and an axial groove terminating proximate said tip disposed in said elongated body of said spike wherein said axial groove is in fluid communication with said axial bore.

8. The road spike device of claim 7 wherein said elongated body has a first diameter and said shank has a second diameter, wherein said second diameter is greater than said first diameter whereby said shank defines a shoulder.

9. The road spike device of claim 7 wherein a first plurality of said hardened spikes are of a first height and a second plurality of said hardened spikes are of a second height wherein said first height is greater than said second height and further wherein said hardened spikes of said first height and said hardened spikes of said second height are disposed in alternating fashion on said support arms.

10. The road spike device of claim 7 wherein said road spike device further comprises a hinged case for transporting and storing said road spike device.

11. The road spike device of claim 7 wherein said road spike device further comprises at least one strap member secured to an end of said road spike device.

12. A road spike device for deflating a pneumatic tire, said road spike device comprising;

a plurality of support arms and base members cooperating in a lazy tong configuration, wherein said support arms are removably secured to adjoining said base members;

a plurality of frangible cups in spaced relation secured to said support arms;

a hardened spike seated in each of said plurality of frangible cups, said hardened spike including a shank, an elongated body, and a tapered tip, said elongated body having a first diameter and said shank having a second diameter, wherein said second diameter is greater than said first diameter whereby said shank defines a shoulder an axial bore provided in said shank of said hardened spike; and an axial groove terminating proximate said tip disposed in said elongated body of said spike wherein said axial groove is in fluid communication with said axial bore.

13. The road spike device of claim 12 wherein said hardened spike further includes at least one circumferential bevel proximate said tapered tip.

14. The road spike device of claim 12 wherein a first plurality of said hardened spikes are of a first height and a second plurality of said hardened spikes are of a second height wherein said first height is greater than said second height and further wherein said hardened spikes of said first height and said hardened spikes of said second height are disposed in alternating fashion on said support arms.

15. The road spike device of claim 12 wherein said road spike device further comprises a hinged case for transporting and storing said road spike device.

16. The road spike device of claim 12 wherein said road spike device further comprises at least one strap member secured to an end of said road spike device.

* * * * *